US007106458B2

(12) United States Patent
Langbein et al.

(10) Patent No.: US 7,106,458 B2
(45) Date of Patent: Sep. 12, 2006

(54) DEVICE FOR DETECTING EDGES OF SHEET-SHAPED MATERIALS

(75) Inventors: Konrad Langbein, Dettingen (DE); Jochen Graeber, Bissingen (DE); Hartwig Huelz, Dettingen (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 499 days.

(21) Appl. No.: 10/318,911

(22) Filed: Dec. 13, 2002

(65) Prior Publication Data

US 2003/0151752 A1 Aug. 14, 2003

(30) Foreign Application Priority Data

Dec. 14, 2001 (DE) ..... 101 61 435

(51) Int. Cl.
*G01N 21/84* (2006.01)

(52) U.S. Cl. ..... 356/615; 356/429

(58) Field of Classification Search ..... 356/614–615, 356/622, 601, 606, 388, 394, 213, 218, 226, 356/429–431; 250/571, 572, 574
See application file for complete search history.

(56) References Cited

U.S. PATENT DOCUMENTS 4,522,497 A * 6/1985 Ikin ..... 356/431
4,845,374 A * 7/1989 White et al. ..... 250/559.4
5,066,865 A * 11/1991 Wennerberg ..... 250/559.01
5,087,925 A * 2/1992 No et al. ..... 347/177
5,389,795 A * 2/1995 Rye ..... 250/559.42
5,847,405 A * 12/1998 Acquaviva et al. .... 250/559.36
5,859,440 A 1/1999 Acquaviva
5,932,888 A 8/1999 Schwitzky
6,444,996 B1 * 9/2002 Boenick et al. ..... 250/559.36
2001/0001576 A1 * 5/2001 Haque et al. ..... 356/429

FOREIGN PATENT DOCUMENTS

DE 195 06 467 A1 8/1996
DE 100 45 261 A1 4/2001
JP 62200206 A 9/1987
JP 06211334 A 8/1994

OTHER PUBLICATIONS

DE Search Report 101 61 435.7.

* cited by examiner

*Primary Examiner*—Michael P. Stafira
(74) *Attorney, Agent, or Firm*—Laurence A. Greenberg; Werner H. Stemer; Ralph E. Locher

(57) ABSTRACT

A device for detecting edges of sheet-shaped print materials (1), especially of transparencies, that are moved along a transport path through a sheet-processing machine has a beam transmitter (31) and a beam receiver (32), whereby beam transmitter (31) and beam receiver (32) are mounted on different sides of the transport path in such a way that the beam path forms an acute angle to the surface of the sheet-shaped print material (1). Electronics (36) evaluate the beam received at the beam receiver (32), whereby the beam receiver (32) is at a lesser distance to the transport path in comparison to the beam transmitter (31).

22 Claims, 2 Drawing Sheets

DEVICE FOR DETECTING EDGES OF SHEET-SHAPED MATERIALS

FIELD OF THE INVENTION

The invention relates to a device for detecting the edges of sheet-shaped print materials, and more particularly a device for detecting the edges of transparencies that are moved along a transport path by a sheet-processing machine.

BACKGROUND

Normally edge detection devices are used to determine the position of a sheet-shaped print material on its way through a sheet-processing machine in order to be able to signal when sheet-shaped print material is present, for example at the start of a printing or further-processing procedure. Examples of sheet-shaped print material are printed or unprinted paper or transparencies.

The detection of a leading or trailing edge of such a sheet-shaped print material is especially important when several processing steps within the sheet-processing machine will have a fixed spatial relationship to the sheet-shaped print material, e.g. the printing of different color separations and/or precisely positioned placement of holes, folds or other processes relative to each other.

To detect the edge of a sheet-shaped print material, many different techniques are used, including the use of optical sensors. Optical sensors may be either reflection or transmission sensors, depending on whether transmitters and receivers are located on the same side of the sheet-shaped print material or on opposite sides of the sheet-shaped print material.

An example of such a system A special problem occurs in the detection of edges of transparencies. An example of attempts to overcome this problem can be found in U.S. Pat. No. 5,139,339, which is hereby incorporated by reference. In that patent, one transmitter and two receivers for beams are mounted above the path of the paper in such a way that the first receiver can only receive light that is reflected diffusely from the surface of the sheet-shaped print material. On the other hand, the second receiver essentially receives a beam that is reflected directly from the surface of the sheet-shaped print material according to linear beam optics. In the absence of a sheet-shaped print material, neither of the receivers receives a reflection. Because of this arrangement, a differentiation can be made between opaque surfaces (e.g. paper), which essentially scatter diffusely and thus mainly generate a signal at the first receiver, and transparent surfaces that mainly generate a signal at the second receiver.

U.S. Pat. No. 5,859,440, which is hereby incorporated by reference, discloses another principle for detection of edges of transparencies, which utilizes the shadow on an edge of a transparent material. If light is radiated at a flat or acute angle onto the edge of a transparent material, then total reflection occurs within the transparent material at the surface of the outer edge so that on the side of the edge opposite to the transmitter a shadowed area develops that can be detected by a suitable optical sensor. A shadow such as this also develops with opaque materials such that the sensor can also be used to detect edges of sheet-shaped print materials.

Japanese patent specification JP 62202206, which is hereby incorporated by reference, shows an optical device for detecting edges of sheet-shaped print materials, in which transmitters and receivers are located on different sides of the sheet-shaped print material. In this case, a broad light source is projected, by means of optics, on the other side of the sheet-shaped print material onto a wide detection line, which senses an exact position of the edge. In order to also detect edges of transparent sheet-shaped print materials, the optical axis between transmitter and receiver forms a flat or acute angle with the surface of the sheet-shaped print material.

Efforts regarding such systems have led to continuing developments to improve their efficiency, versatility, and practicality.

DETAILED DESCRIPTION

Figure 1:
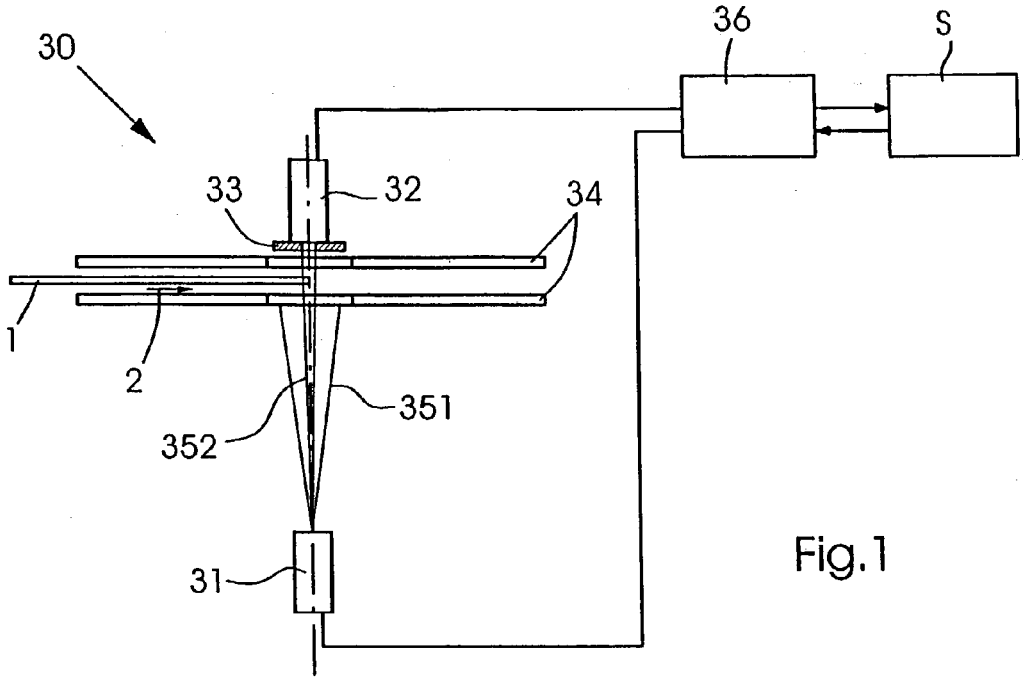
FIG. 1 shows a schematic representation of a cross section through the arrangement of a device in accordance with the present invention, along the direction of movement of the sheet-shaped print materials.

Referring now to the drawings, wherein like reference numerals like or corresponding parts throughout the different views, there is shown an arrangement of the individual components of a device in accordance with the invention.

A beam transmitter or sender 31 is mounted underneath a transport path for sheet-shaped print materials 1 for transmitting a beam of light energy. Beam transmitter 31 may be an infrared light-emitting diode supplied with power in the form of a high-frequency pulse. The transport path for the sheet-shaped print materials 1 is limited at the top and bottom by sheet guides 34 so that the sheet-shaped print material 1 moves through the device 30 in a defined plane in the direction of the arrow marked with reference number 2.

Just above the transport path, in alignment with the beam 35 emitted from sender 31, a beam receiver 32 is mounted, which in the case of this embodiment is an infrared light sensitive diode. In front of the beam receiver 32, a diaphragm 33 is mounted, advantageously a slotted diaphragm 33, whereby the slot is parallel to the leading edge of a sheet-shaped print material 1 passing by. The slot may be rectangular, with the long side of the rectangle being in the plane formed by the normal and the front edge. In FIG. 1, the slot is shown along it's short length. The diaphragm may be tilted relative to the print material so that the beam and diaphragm are perpendicular. A beam 351 that is sent from beam transmitter 31 and expanded to a beam cone is reduced by diaphragm 33 to a narrow active beam 352, which alone contributes to a signal at the beam receiver 32. Other beam wavelengths are also conceivable, however, the interfering influence of outside light is greater with visible light. With UV light, with which a still better high-sensitivity resolution can be achieved, there are other problems, e.g. scattered light that is possibly hazardous to a user.

The characteristics of transparent materials, which are described by Fresnel formulas, namely that the rate of reflection of a transparent surface depends on the angle of incidence of the beam and increases markedly with increasing angle to the lead of the surface is used to detect edges. The angle between the beam and the print materials is preferably acute, or smaller than 45 degrees, for example in the range of 15 to 20 degrees or less. The smaller the angle, the more light 353 is reflected off the surface of the print material.

The beam receiver 32 is mounted relatively closer to the transport path of the sheet-shaped print materials 1 than the beam transmitter 31. Infrared light emitting diodes typically have a relatively wide beam cone (e.g. in comparison to a laser). Because of the relatively greater distance from the beam transmitter to the sheet-shaped print material 1, the divergence of the active beam 352 is low in the edge area and thus in the area of the nearby beam receiver. In order to prevent further scattered light, a diaphragm 33' may be mounted in front of beam transmitter 31 (see FIG. 2).

Because the beam receiver is at a lesser distance to the transport path in comparison to the beam transmitter, the beam has only a slight divergence in the area of the sheet-shaped print material, which improves the accuracy of position determination.

The diaphragm is mounted directly in front of the beam receiver. Because of this, the portion of the beam from the transmitter that arrives at the receiver can be further reduced and the accuracy of position determination can be further improved. By reducing the beam diameter with the aid of the aperture plate right in front of the receiver, the beam transmitter can send a beam cone that is large in comparison to the slot width. Because of this and because of the relatively large distance between transmitter and surface of the sheet-shaped print material as according to the present invention, installation and alignment of the beam transmitter with regard to the beam receiver in the housing is greatly simplified.

The beam path runs in the plane of the edge of the sheet-shaped print material, i.e. essentially parallel to the edge to be detected and normally to the surface of the sheet-shaped print material. In this way, the effective width of the edge can be reduced to a minimum and a signal edge of the beam receiver that is relevant for high sensitivity resolution is more pronounced. In addition to reducing the signal by the reflection on the underside of the sheet-shaped print material, diffraction effects occur at the edge of the sheet-shaped print material that cause a signal change in the beam receiver.

The beam transmitter is mounted below the transport path in such a way that the leading edge and/or trailing edge of a sheet-shaped print material is detected. The detection of an edge parallel to the transport path of the sheet-shaped print material is also within the scope of the invention. Such an arrangement of the device is advantageous for lateral registration of a sheet-shaped print material. Detection of leading edges is especially advantageous for triggering procedures in a sheet-processing machine, e.g. the placement of holes in precise positions. Together with the detection of a trailing edge of the sheet-shaped print material, an exact length measurement can be carried out on a moving sheet-shaped print material by using suitable electronics.

Figure 2:
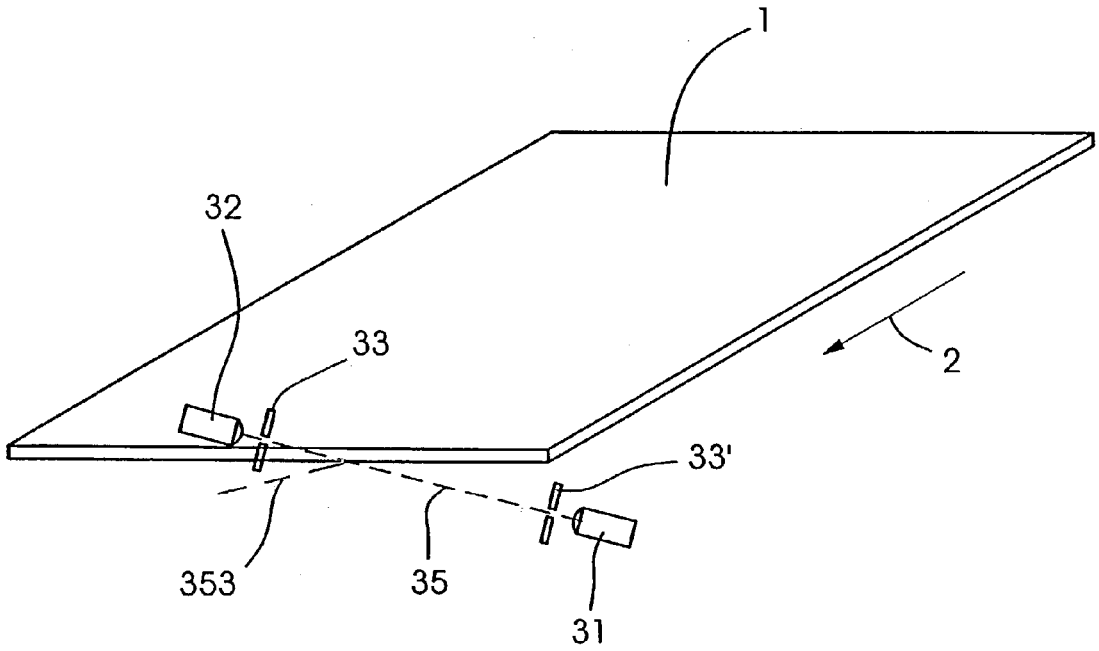
FIG. 2 shows a three-dimension schematic representation of the arrangement of the sheet-shaped print materials in the device in accordance with the invention.

Referring now to FIG. 2, beam transmitter 31 and beam receiver 32 are mounted such that the beam path 35 has a flat or acute angle to the sheet-shaped print material 1, parallel to the edge of sheet-shaped print material 1. This serves for better detection of transparent sheet-shaped print materials 1. The rate or amount of reflection of light incident on the surface of transparent materials increases with increasing angle to the perpendicular of the plane of the surface of the material as pursuant to Fresnel formulas, even with high-grade transparent sheet-shaped print materials. As the amount of reflection increases, there is a decrease in the signal at the beam receiver 32, which can thereby be used to detect to the edge of a moving transparent sheet-shaped print material 1 using a suitable electronic evaluation circuit 36.

Figure 3:
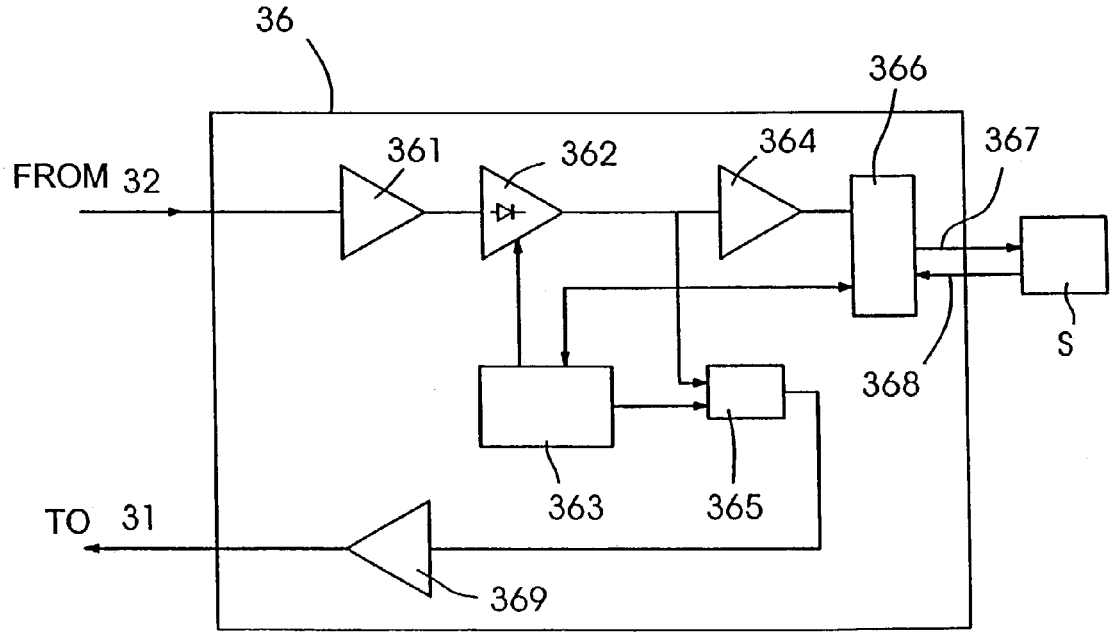
FIG. 3 shows a schematic version of an electronics circuit as used a device in accordance with the invention.

Evaluation electronics 36 such as this, which are shown in more detail in FIG. 3, are connected to the beam transmitter 31 and beam receiver 32. The high-frequency pulsed signal of the beam receiver 32 is amplified by an amplifier 361 and then demodulated with a demodulator 362. The demodulator 362 is connected to a comparator 364 and a controller 365. The comparator 364 provides a control signal to an interference suppression unit 366 which thereby provides a filtered output "edge" signal 367 to a higher-level control system S of a sheet-processing machine (not shown, but known to those person skilled in the art) and thus indicates or reports the change in the signal of the beam receiver 32 when an edge is present. By way of a transmission amplifier 369, which is connected to the beam transmitter 31, the controller 365 ensures that the beam intensity of beam transmitter 31 is regulated in such a way that a constant receiving level occurs at the demodulator 362.

The higher-level control system S supplies an input signal "activation" 368 to a sequence control system 363 to carry out a calibration of the signal level at the comparator 364. A calibration such as this may be carried out shortly before the presumable detection of an edge. In this process, it is assumed that the higher-level control of the sheet-processing machine approximately knows the position of the sheet-shaped print materials 1 on the transport path through the sheet-processing device. The interference suppression 366 switches off the output signal 367 as soon as the edge has been detected and the output signal "edge detected" has been supplied to the higher-level control S. As soon as the sheet-shaped print material 1 has completely passed the beam receiver 32, the higher-level control supplies an input signal 368 to the electronics, whereby among other things, the interference suppression 366 again releases the output signal 367 of the beam receiver 32. This prevents incorrect detection of edges, e.g. of text on a transparent sheet-shaped print material 1. It is to be noted that even the edges of transparent materials which have printing on them can be detected precisely.

Because of the calibration, the signal of the beam receiver 32 will be adjusted before detecting an edge under ambient conditions by means of the controller 365 and the transmission amplifier 369 in such a way that, as described, a near constant beam intensity is present at demodulator 362. In this way, even small deviations in the beam intensity, as they are caused by e.g. highly transparent sheet-shaped print materials 1, can be reliably detected and the position of an edge can be assigned.

It can be seen that the electronics have a control loop to compensate for the signals of the beam receiver. In the control circuit, the beam transmitter is regulated on the basis of the signal received in such a way as to cause an essentially constant intensity of the beam that arrives at the receiver. In this process, due to the measures described above, it does not matter whether it is an edge of a transparent sheet-shaped print material 1 or of an opaque sheet-shaped print material 1.

The receiver is calibrated under ambient conditions using electronics shortly before the edge detection. Because of this, even a very slight signal change in the receiver, a useable signal, which corresponds to the position of the edge of the sheet-shaped print material, can be evaluated. A low signal such as this could occur, e.g. due to the presence of a transparent material. By calibrating the receiver shortly before detection of this edge, environmental influences like temperature fluctuations, variations in beam intensity, aging effects, soiling, non-linearities of the transmitter and/or of the receiver, etc. can be compensated. This calibration may be carried out in cycles, for instance after passage of each sheet-shaped print material.

Also, the electronics suppress an output signal from the beam receiver as soon as an edge has been detected, until the electronics receive an input signal that releases the output signal of the beam receiver again. This is especially effective in edge detection of transparencies. For printed transparences, e.g. a line pattern at the beam receiver can also trigger a signal, similar to that triggered by the leading edge. Because of upstream interference suppression, such interference signals can be prevented, in that the output signals of the beam receiver are not sent on to a higher-level control as soon as the position of the outer edge has been detected. The higher-level control does not release the beam receiver again until the sheet-shaped print material has completely passed the beam receiver.

As noted, the beam transmitter may be operated in high-frequency pulse operation. This reduces the influence of outside light on the receiver signal. A suitable lock-in amplifier or comparable electronics allow for the discrimination of the high-frequency signal from the ambient light or other influences.

Although the use of the device according to the invention has been described here for detecting a leading edge, in the same way, it can be used for detecting a trailing or lateral edges of print materials. Moreover, the present invention can also be used to detect edges of a static print material if the device is mounted so that it can move appropriately.

The invention claimed is:

1. A device for detecting edges of sheet-shaped print materials that are moved along a transport path through a sheet-processing machine comprising:

a beam transmitter for transmitting a light beam towards the print materials;

a beam receiver which receives the light beam and provides a beam indicator signal indicative thereof, wherein the beam transmitter and beam receiver are disposed on opposite sides of the transport path in such a way that the beam forms an angle of 45° or less to the surface of the sheet-shaped print material; and a controller for evaluating the beam indicator signal and detecting the sheet-shaped materials, wherein the beam receiver is disposed a lesser distance to the transport path than the beam transmitter.

2. A device according to claim 1, further comprising a slotted diaphragm disposed in front of the beam receiver.

3. A device according to claim 1, wherein the beam path runs in the plane of the edge of the sheet-shaped print material.

4. A device according to claim 1, wherein the beam transmitter is mounted below the transport path.

5. A device according to claim 1, wherein the controller calibrates the beam indicator signal under ambient conditions shortly before detection of an edge of the sheet-shaped materials.

6. A device according to claim 5, wherein the calibration is carried out in cycles.

7. A device according to claim 5, wherein the calibration is carried out before or after passage of each sheet-shaped print material.

8. A device according to claim 5, wherein the controller suppresses the beam indicator signal for a period of time after edge detection.

9. A device according to claim 1, wherein the beam transmitter is operated in high frequency pulse operation.

10. A device according to claim 1, further comprising a control loop to compensate for the beam indicator signal.

11. A device according to claim 1, wherein the light beam is infrared.

12. A method for detecting edges of sheet-shaped print materials that are moved along a transport path through a sheet-processing machine comprising the steps of:

transmitting a light beam from a beam transmitter towards the sheet-shaped print materials at an angle of 45° or less angle to the surface thereof;

receiving the light beam with a beam receiver and providing a beam indicator signal indicative thereof, wherein the beam transmitter and beam receiver are disposed on opposite sides of the transport path;

evaluating the beam indicator signal and detecting the sheet-shaped materials; and, wherein the beam receiver is disposed a lesser distance to the transport path than the beam transmitter.

13. A method according to claim 12, further comprising reducing the beam diameter with a slotted diaphragm disposed in front of the beam receiver.

14. A method according to one of claim 12, wherein the beam path runs in the plane of the edge of the sheet-shaped print material.

15. A method according to claim 12, wherein the beam transmitter is mounted below the transport path.

16. A method according to claim 12, further comprising the step of calibrating the beam indicator signal under ambient conditions shortly before detection of an edge of the sheet-shaped materials.

17. A method according to claim 16, wherein the calibrating step is carried out in cycles.

18. A method according to claim 16, wherein the calibrating step is carried out before or after passage of each sheet-shaped print material.

19. A method according to claim 16, further comprising the step of suppressing the beam indicator signal for a period of time after edge detection.

20. A method according to claim 12, wherein transmitting step is transmitting in high frequency pulse operation.

21. A method according to claim 12, further comprising the step of compensating for the beam indicator signal through a control loop.

22. A method according to claim 12, wherein the light beam is infrared.

* * * * *